US010325551B2

(12) United States Patent
Lee et al.

(10) Patent No.: US 10,325,551 B2
(45) Date of Patent: Jun. 18, 2019

(54) LED DRIVING APPARATUS, DISPLAY APPARATUS AND METHOD FOR DRIVING LED

(71) Applicant: SAMSUNG ELECTRONICS CO., LTD., Suwon-si, Gyeonggi-do (KR)

(72) Inventors: Sang-hoon Lee, Suwon-si (KR); Du-hee Jang, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 128 days.

(21) Appl. No.: 15/473,679

(22) Filed: Mar. 30, 2017

(65) Prior Publication Data

US 2018/0053467 A1 Feb. 22, 2018

(30) Foreign Application Priority Data

Aug. 16, 2016 (KR) ..... 10-2016-0103544

(51) Int. Cl.
*G09G 3/32* (2016.01)

(52) U.S. Cl.
CPC ..... *G09G 3/32* (2013.01); *G09G 2310/08* (2013.01); *G09G 2320/0626* (2013.01); *G09G 2330/025* (2013.01); *G09G 2360/16* (2013.01)

(58) Field of Classification Search
CPC .. G09G 3/32; G09G 2310/08; G09G 2360/16; G09G 2330/025; H05B 33/083
See application file for complete search history.

(56) References Cited

U.S. PATENT DOCUMENTS

| | | | | |
|---|---|---|---|---|
| 8,264,449 | B2 | 9/2012 | Liao et al. | |
| 2007/0296354 | A1 | 12/2007 | Okabe | |
| 2008/0061716 | A1* | 3/2008 | Kim | G09G 3/3413 315/307 |
| 2008/0088571 | A1* | 4/2008 | Lee | G09G 3/3406 345/102 |
| 2013/0050289 | A1* | 2/2013 | Kang | G09G 3/342 345/690 |
| 2013/0313972 | A1 | 11/2013 | Hulett | |
| 2014/0001975 | A1 | 1/2014 | Lee et al. | |
| 2015/0302792 | A1 | 10/2015 | Lu et al. | |

FOREIGN PATENT DOCUMENTS

| | | |
|---|---|---|
| JP | 2007-324416 | 12/2007 |
| KR | 10-2008-0023810 | 3/2008 |
| KR | 10-2013-0130434 | 12/2013 |
| KR | 10-2014-0001002 | 1/2014 |

* cited by examiner

*Primary Examiner* — Alexander Eisen
*Assistant Examiner* — Mansour Said
(74) *Attorney, Agent, or Firm* — Nixon & Vanderhye P.C.

(57) ABSTRACT

An LED driving apparatus, a display apparatus and an LED driving method are provided. The LED driving apparatus according to an example embodiment may include a plurality of LEDs configured to represent a different color, respectively, a constant current supply configured to supply constant current to each of the plurality of LEDs, and a controller configured to control the constant current supply to apply constant current to each of the plurality of LEDs at different points in time.

10 Claims, 11 Drawing Sheets

LED DRIVING APPARATUS, DISPLAY APPARATUS AND METHOD FOR DRIVING LED

CROSS-REFERENCE TO RELATED APPLICATION

This application is based on and claims priority under 35 U.S.C. § 119 to Korean Patent Application No. 10-2016-0103544, filed in the Korean Intellectual Property Office on Aug. 16, 2016, the disclosure of which is incorporated by reference herein in its entirety.

BACKGROUND

1. Field

The present disclosure relates generally to an LED driving apparatus, a display apparatus and an LED driving method, and for example, to an LED driving apparatus which may reduce peak output current, a display apparatus and an LED driving method.

2. Description of Related Art

Conventionally, an LED has been used as a backlight of a Liquid Crystal Display (LCD). Due to a response characteristic of an LCD displaying an image signal, an LCD apparatus controls brightness of a backlight by aligning light emission of an LED uniformly in one direction from a time axis.

Recently, LED display apparatuses which do not use an LED light source as a backlight but use an LED light source to directly display an image have been popularized. However, such the LED display apparatuses employ the method of a conventional LCD apparatus, and controls brightness by aligning LED light emission uniformly in one direction.

To improve image quality, an LED display apparatus provides current applied to an LED after dividing the current through alignment methods of a head alignment, a tail alignment and a center alignment with reference to a synchronization signal of an image. A recent LED display apparatus, however, still uses one same alignment method for LEDs representing all colors (e.g., R, G and B).

If an LED operates by current aligned in one direction, the sections in which an LED of each color is simultaneously lighted increase. Accordingly, a power supply needs to frequently supply high-peak current. The frequent provision of peak current may increase heat emission and stress of a component.

SUMMARY

An aspect of example embodiments relates to an LED driving apparatus which may reduce peak current by dispersing a lighting time of an LED of each color, a display apparatus and an LED driving method.

According to an example embodiment, an LED driving apparatus is provided, the LED driving apparatus including a plurality of LEDs configured to represent a different color, respectively, a constant current supply configured to supply constant current to each of the plurality of LEDs, and a controller configured to control the constant current supply to apply constant current to each of the plurality of LEDs at different points in time.

The controller may determine a driving section of each of the plurality of LEDs to minimize and/or reduce an overlapping section of a driving time of each of the plurality of LEDs, and control the constant current supply to supply constant current in the determined driving section.

The controller may determine a driving time of each of the plurality of LEDs which corresponds to brightness of an input image.

The controller may control the current supply to supply constant current for one of the plurality of LEDs to a front end of a frame, constant current for another one of the plurality of LEDs to a middle of the frame and constant current for remaining LEDs to a rear end of the frame.

The each of the plurality of LEDs may comprise LEDs representing red, green (G) and blue (B), and the controller may control the current supply to supply constant current for an LED representing R to a front end of a frame, constant current for an LED representing G to a middle of the frame, and constant current for an LED representing B to a rear end of the frame.

The each of the plurality of LEDs may comprise LEDs representing R, G and B, and the controller may determine a driving time of each of the plurality of LEDs representing R, G and B, and control the current supply to supply constant current for an LED having a longest driving time to a middle of a frame and constant current for remaining LEDs to a front end or a rear end of the frame.

The controller may change a driving start point of an LED in which constant current is supplied to a middle in order to minimize and/or reduce an overlapping section between a driving time of an LED in which the constant current is supplied in the middle and a driving time of remaining LEDs.

The controller may determine a driving section arrangement for each LED representing R, G and B at every frame unit.

According to an example embodiment, a display apparatus is provided, the display apparatus including an LED panel configured to receive an image signal, and to receive a plurality of driving powers for each of a plurality of LEDs representing a different color, respectively, and display an image, an image signal providing unit comprising image signal providing circuitry configured to provide an image signal to the LED panel, and an LED driver configured to apply constant current to each of the plurality of LEDs at different points in time.

The LED driver may determine a driving section of each of the plurality of LEDs to minimize and/or reduce an overlapping section of a driving time of each of the plurality of LEDs, and supply constant current in the determined driving section.

The LED driver may control the current supply to supply constant current for one of the plurality of LEDs to a front end of a frame, constant current for another one of the plurality of LEDs to a middle of the frame and constant current for remaining LEDs to a rear end of the frame.

The each of the plurality of LEDs may comprise LEDs representing R, G and B, and the controller may control the current supply to supply constant current for an LED representing R to a front end of a frame, constant current for an LED representing G to a middle of the frame, and constant current for an LED representing B to a rear end of the frame.

The each of the plurality of LEDs may comprise LEDs representing R, G and B, and the LED driver may determine a driving time of each of the plurality of LEDs representing R, G and B, and control the current supply to supply constant current for an LED having a longest driving time to a middle of a frame and constant current for remaining LEDs to a front end or a rear end of the frame.

The controller may change a driving start point of an LED in which constant current is supplied to a middle in order to minimize and/or reduce an overlapping section between a driving time of an LED in which the constant current is supplied in the middle and a driving time of remaining LEDs.

According to an example embodiment, a method for driving a plurality of LEDs configured to represent a different colors, respectively, is provided, the method may include determining a driving section of each of the plurality of LEDs to minimize and/or reduce an overlapping section of a driving time of each of the plurality of LEDs, and applying constant current to each of the plurality of LEDs in the determined driving section.

The method may further include determining a driving time of each of the plurality of LEDs which corresponds to brightness of an input image.

The determining may include determining a driving section to control to supply constant current for one of the plurality of LEDs to a front end of a frame, constant current for another one of the plurality of LEDs to a middle of the frame and constant current for remaining LEDs to a rear end of the frame.

The determining may include determining a driving section to control to supply constant current for an LED having a longest driving time to a middle of a frame and constant current for remaining LEDs to a front end or a rear end of the frame.

According to various example embodiments described above, an LED driving apparatus may reduce heat emission and stress of a power circuit by reducing a value of output current peak.

BRIEF DESCRIPTION OF THE DRAWINGS

The above and other aspects, features and attendant advantages of the present disclosure will be more readily appreciated and understood from the following detailed description, taken in conjunction with the accompanying drawings, in which like reference numerals refer to like elements, and wherein.

DETAILED DESCRIPTION

Hereinafter, various example embodiments will be described in greater detail with reference to the accompanying drawings. In the following description, well-known functions or constructions may not described in detail if they would obscure the application with unnecessary detail. The terms used in an example embodiment are defined in consideration of a function described in an example embodiment, and the terms may vary according to an intention of a technician practicing in the pertinent art, an advent of new technology, etc. Accordingly, the terms used in the description should be defined based on overall contents of example embodiments.

The terms such as "first" and "second" may be used to explain various elements, but the elements should not be limited by these terms. The terms used in the following description are provided to explain various example embodiments and are not intended to limit the scope of rights. For example, a first element may be named a second element without departing from the scope of right of the various example embodiments, and similarly, a second element may be named a first element. The term "and/or" includes a combination of a plurality of described relevant items or any item of a plurality of described relevant items.

The terms used in various embodiments of the present disclosure are for the purpose of describing particular embodiments and are not intended to limit the present disclosure. A singular term includes a plural form unless it is intentionally written that way. In addition, it should be understood that the terms "include" or "have" used in the example embodiments of the present disclosure are to indicate the presence of features, numbers, steps, operations, elements, parts, or a combination thereof described in the specifications, and do not preclude the presence or addition of one or more other features, numbers, steps, operations, elements, parts, or a combination thereof.

Figure 1:
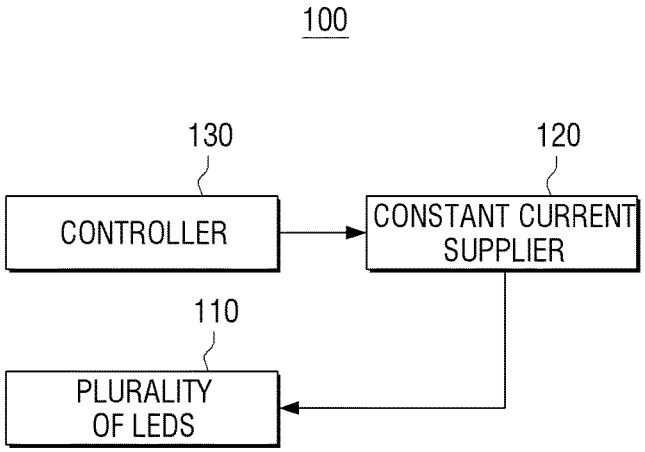
FIG. 1 is a block diagram illustrating an example configuration of an LED driving apparatus according to an example embodiment.

FIG. 1 is a block diagram illustrating an example configuration of an LED driving apparatus 100 according to an example embodiment. For example, the LED driving apparatus 100 may not use an LED as a backlight but use an LED to directly represent an image. As the LED driving apparatus 100 uses an LED to directly represent an image, there is no delay in responding to changes in an image signal. Therefore, as shown in the example embodiment, image quality may not be deteriorated even when the lighting time of each color of LED is dispersed.

Referring to FIG. 1, the LED driving apparatus 100 may include a plurality of LEDs 110, a constant current supplier (e.g., including current supply circuitry) 120 and a controller (e.g., including processing circuitry) 130. Although it is not illustrated in FIG. 1, the LED driving apparatus 100 may include a component such as a power supply 150.

The plurality of LEDs 110 may include LEDs which represent a different color, respectively. For example, the plurality of LEDs 110 may include LEDs which emit light of colors red (R), green (G) and blue (B), respectively.

The constant current supplier 120 may include various current supply circuitry to selectively provide constant current to the plurality of LEDs 110 under control of the controller 130. The constant current supplier 120 may, for example, include a plurality of current supplying blocks which take charge of each of the plurality of LEDs 110 which represent a different color, respectively. The constant current supplier 120 may determine a time for applying constant current according to duty information of each of the plurality of LEDs 110. The controller 130 may analyze brightness of an image and generate duty information which indicates for how long constant current needs to be applied to an LED.

The controller 130 may include various processing circuitry and control the constant current supplier 120 to apply constant current to each of the plurality of LEDs 110 at different points in time. The controller 130 may determine a section in which constant current is applied to each of the plurality of LEDs so as to minimize and/or reduce an overlapping section of a driving time in which constant current is applied to each of the plurality of LEDs 110. For example, if each of LEDs respectively representing colors R, G and B operates in a different section, a current peak value of the LED driving apparatus 100 may not occur.

Figure 2:
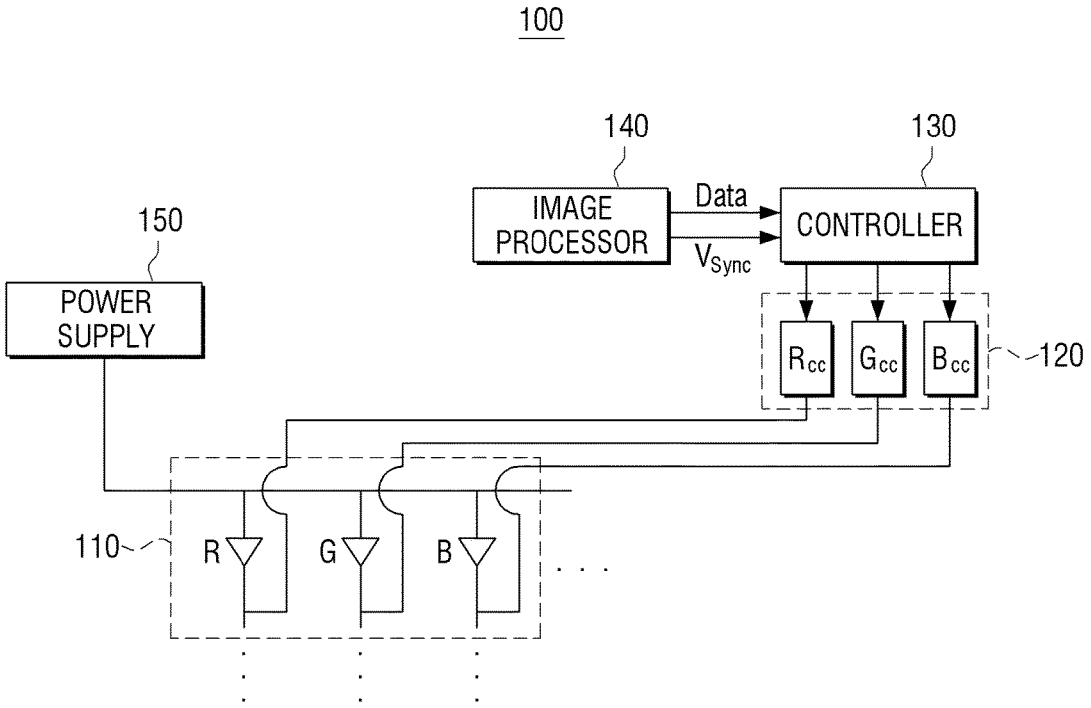
FIG. 2 is a diagram illustrating an example configuration of an LED driving apparatus according to an example embodiment.

FIG. 2 is a diagram illustrating an example configuration of the LED driving apparatus 100 according to an example embodiment. Referring to FIG. 2, the LED driving apparatus 100 may include the plurality of LEDs 110, the constant current supplier 120, an image processor 140 and the power supply 150.

The image processor 140 may include various image processing circuitry to process an input image signal, and transmit image data and a synchronization signal to the controller 130. For example, and without limitation, the image processor 140 may be implemented by an image signal processor (ISP), a graphic processing unit (GPU) or the like.

The power supply 150 may supply power to each of the plurality of LEDs 110. For example, and without limitation, the power supply 150 may be implemented by a switched-mode power supply (SMPS). An SMPS may convert DC input voltage into square-wave type voltage using a semiconductor element such as an MOSFET used for current as a switch, and output the controlled DC output voltage through a filter. The SMPS may be suitable for the LED driving apparatus 100 as the SMPS is advantageous in miniaturization and can be manufactured as lightweight.

The power supply 150 may be connected to an end of each of the plurality of LEDs 110. The other end of each of the plurality of LEDs 110 may be connected with the constant current supply 120.

The controller 130 may include various processing circuitry to process image data received from the image processor 140, and separate the received image data into image signals for each of R, G and B. The controller 130 may calculate (determine) the time in which constant current corresponding to brightness of each of the separated image signals is applied.

The input image signal may be classified by a frame unit with reference to a synchronization signal. The controller 130 may arrange a driving section for each of LEDs representing R, G and B in a front end, a middle and a rear end. For example, the controller 130 may control the constant current supply 120 to apply constant current to an LED representing R at a start point of a frame. Also, the controller 130 may control the constant current supply 120 to apply constant current to an LED representing G before and after a middle point of the frame. The controller 130 may also control the constant current supply 120 to apply constant current to an LED representing B in a previous time direction from an end point of the frame.

The controller 130 may determine a driving time of each of LEDs representing R, G and B, and control the constant current supplier 120 to supply constant current for two LEDs having a shorter driving time to a front end or a rear end of a frame. Also, the controller 130 may control the constant current supplier 120 to supply constant current for an LED having a longest driving time to a middle of the frame. The controller 130 may move the driving section of the LED having a longest driving time to minimize and/or reduce an overlapping section between the driving section of the LED having a longest driving time and the driving section of the remaining LEDs.

At every frame, the controller 130 may determine the section of a frame in which a driving section of an LED of each colors is arranged and the arrangement position of a driving section of an LED in which an overlapping section is minimized. That is because brightness of R, G and B which is required to represent an image may be different in each frame.

The specific operation of the controller 130 will be described with reference to FIGS. 5A to 7.

Meanwhile, it is described that the LED driving apparatus 100 may be implemented as a separate apparatus. However, the LED driving apparatus 100 may be implemented such that the LED driving apparatus 100 is included in a display apparatus 200.

Figure 3:
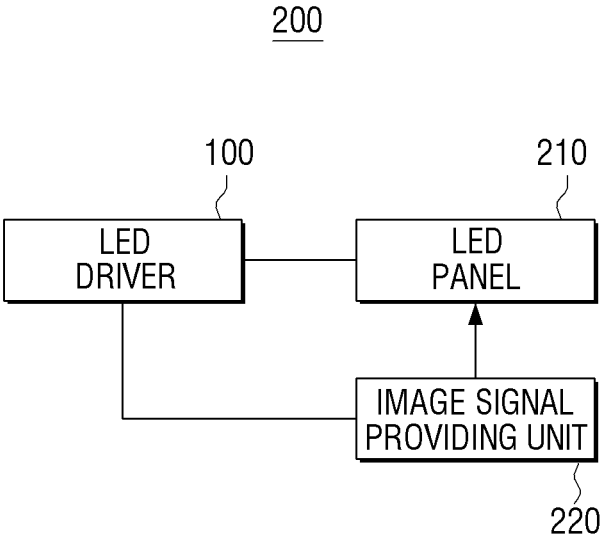
FIG. 3 is a block diagram illustrating an example configuration of a display apparatus according to an example embodiment.

FIG. 3 is a block diagram illustrating an example configuration of the display apparatus according to an example embodiment. Referring to FIG. 3, the display apparatus 200 according to an example embodiment may include an LED panel 210, an image signal providing unit (e.g., including image signal providing circuitry) 220 and an LED driver 100.

The LED panel 210 may receive an image signal, and receive a plurality of driving powers for each of the plurality of LEDs representing a different color, respectively, and display an image. For example, the LED panel 210 may display an image in response to an image signal provided from the image signal providing unit 220 which will be described later and a plurality of driving powers supplied from the LED driver 100. To achieve this, the LED panel 210 may be equipped with a plurality of pixels including LEDs respectively representing a different color.

The image signal providing unit 220 may include various circuitry to provide an image signal to the LED panel 210. For example, the image signal providing unit 220 may, in response to image data, supply image data and/or various image signals for displaying image data to the LED panel 210. The image signal herein may include duty information which transfers information of a light emission level.

The LED driver 100 may apply constant current to the LED panel 210. For example, the LED driver 100 may supply a plurality of driving powers by applying constant current to each of the plurality of LEDs representing a different color, respectively, at different points in time.

Figure 4:
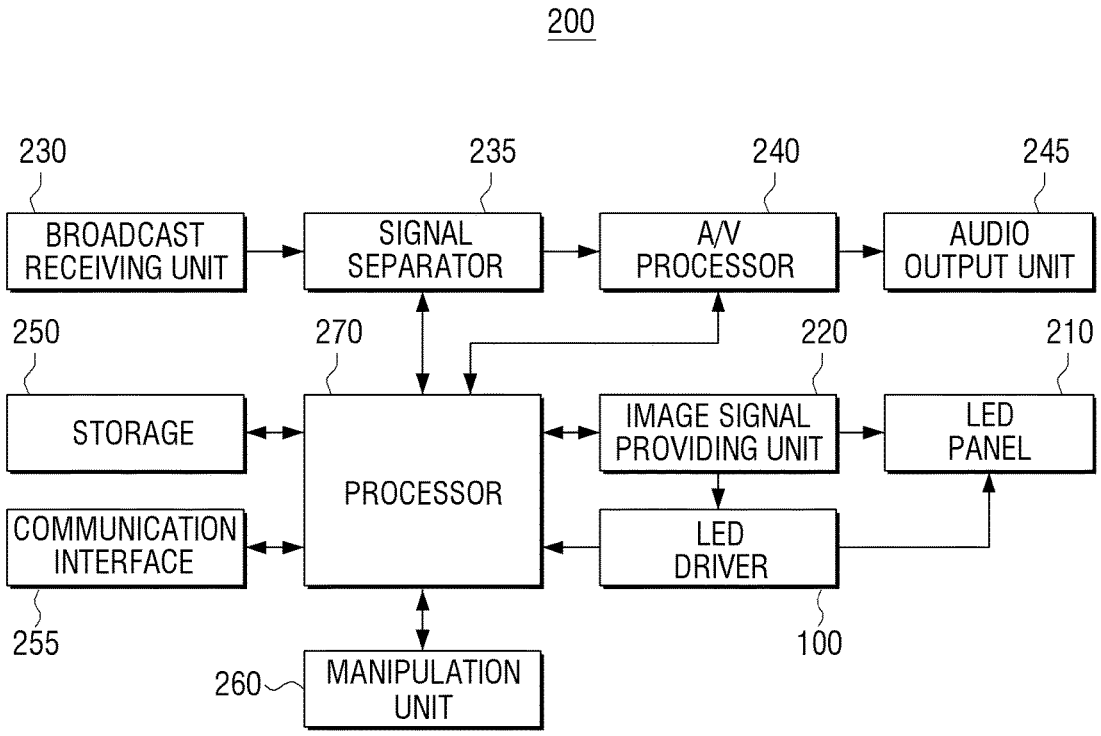
FIG. 4 is a block diagram illustrating an example configuration of a display apparatus according to an example embodiment.

In the above-described embodiments, the configuration of the display apparatus 200 has been described briefly, but the display apparatus 200 may include the configuration described in FIG. 4. The specific configuration of the display apparatus 200 will be described with reference to FIG. 4.

FIG. 4 is a block diagram illustrating an example configuration of the display apparatus 200 according to an example embodiment. Referring to FIG. 4, the display apparatus 200 according to an example embodiment may include the LED panel 210, the image signal providing unit 220, a broadcast receiving unit (e.g., a broadcast receiver) 230, a signal separator (e.g., including signal separating circuitry) 235, an A/V processor 240, an audio output unit (e.g., including audio output circuitry) 245, a storage 250, a communication interface (e.g., including communication circuitry) 255, a manipulation unit (e.g., including input circuitry) 260, a processor (e.g., including processing circuitry) 270 and the LED driver 100.

As the operations of the LED panel 210 and the LED driver 100 are the same as in FIG. 3, and as such, a repeated description will not be provided.

The broadcast receiving unit 230 may include, various broadcast receiving circuitry, such as, for example, and without limitation, a broadcast receiver to receive a broadcast from a broadcasting station or a satellite via cable or wirelessly and demodulate the received broadcast.

The signal separator 235 may include various circuitry to separate a broadcasting signal into an image signal, an audio signal and an additional information signal. The signal separator 235 then may transmit the image signal and the audio signal to the A/V processor 240.

The A/V processor 240 may include various circuitry to perform a video decoding, a video scaling, an audio decoding, etc. to the image signal and the audio signal that have been input from the broadcast receiving unit 230 and the storage 250. The A/V processor 240 then may output the image signal to the image signal providing unit 220 and the audio signal to the audio output unit 245.

Meanwhile, if the received image and audio signals are stored in the storage 250, the A/V processor 240 may output the image and audio to the storage 250 in a compressed format.

The audio output unit 245 may include various audio output circuitry to convert the audio signal output from the A/V processor 240 into a sound, and output the converted sound through a speaker (not illustrated) or output the sound to an connected external device through an external output terminal (not illustrated).

The image signal providing unit 220 may include various image signal providing circuitry to generate a graphic user interface (GUI) to be provided to a user and add the generated GUI to an image output from the A/V processor 240. The image signal providing unit 220 may also provide an image signal corresponding to the image in which the GUI is added to the LED panel 210. Accordingly, the LED panel 210 may display various information provided by the display apparatus 200 and the image transferred from the image signal providing unit 220.

The storage 250 may store an image content. For example, the storage 250 may receive, from the A/V processor 240, an image content in which an image and audio are compressed, and store the image content. The storage 250 may also output the stored image content to the A/V processor 240 according to control of the processor 270. The storage 250 may be implemented by a hard disk, a non-volatile memory, a volatile memory, or the like.

The manipulation unit 260 may include various input circuitry and be implemented as a touch screen, a touch pad, a key button and a key pad, or the like, but is not limited thereto, and provide a user manipulation of the display apparatus 200. In the example embodiment, although it is described that a control command is received through the manipulation unit 260 equipped in the display apparatus 200, the manipulation unit 260 may also receive a user manipulation from an external control apparatus (e.g., a remote controller).

The communication interface 255 may include various communication circuitry to connect the display apparatus 200 to an external apparatus (not illustrated). The communication interface 255 may not only be connected to an external apparatus through a local area network (LAN) and an Internet network, but also through a universal serial bus (USB) port.

The processor 270 may include various processing circuitry to control overall operations of the display apparatus 200. For example, the processor 270 may control the image signal providing unit 220 and the LED panel 210 to display an image according to a control command input through the manipulation unit 260.

As aforementioned, the display apparatus 200 according to an example embodiment may reduce heat emission and stress of a power circuit by dispersing the driving time of a driving section of each primary color LED.

Meanwhile, in the description of FIG. 4, it is described that the aforementioned function may be applied only to the display apparatus which receives and displays a broadcast. However, the LED driving apparatus 100 may be applied to any electronic apparatus that has an LED panel.

Figure 5A:
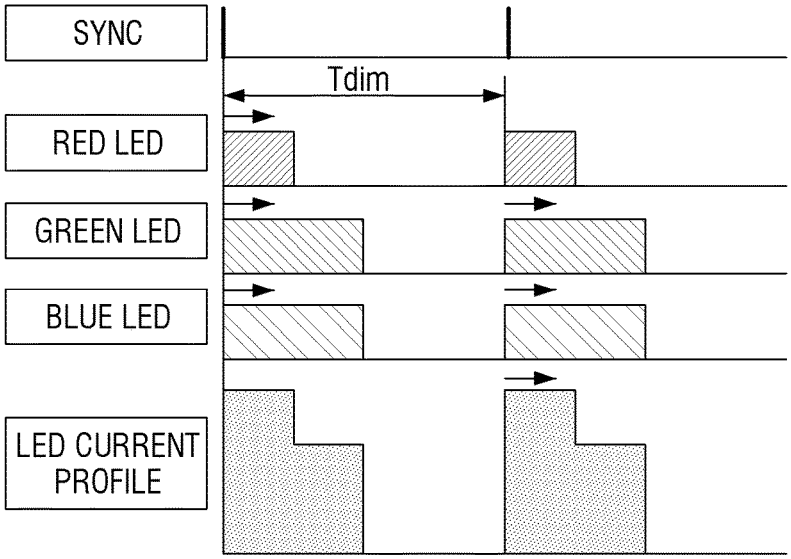
FIGS. 5A, 5B and 5C are diagrams illustrating an example alignment method for aligning LED current.
Figure 5B:
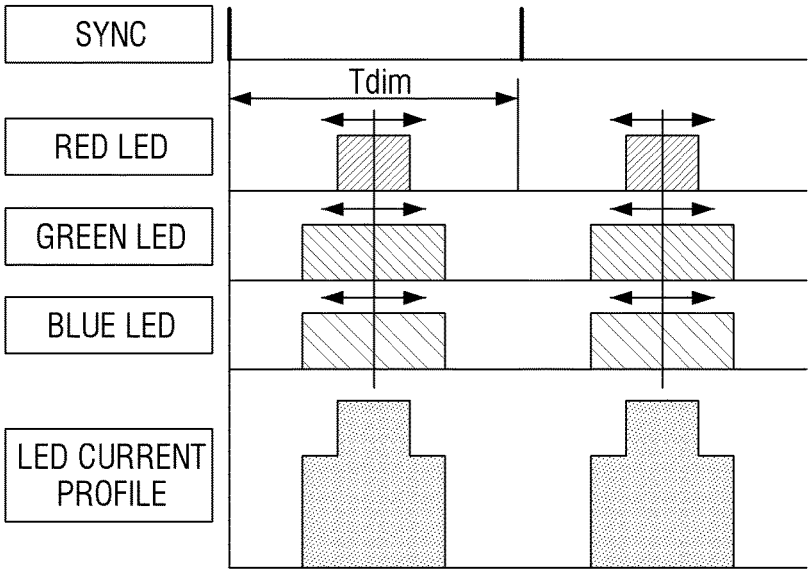
Figure 5C:
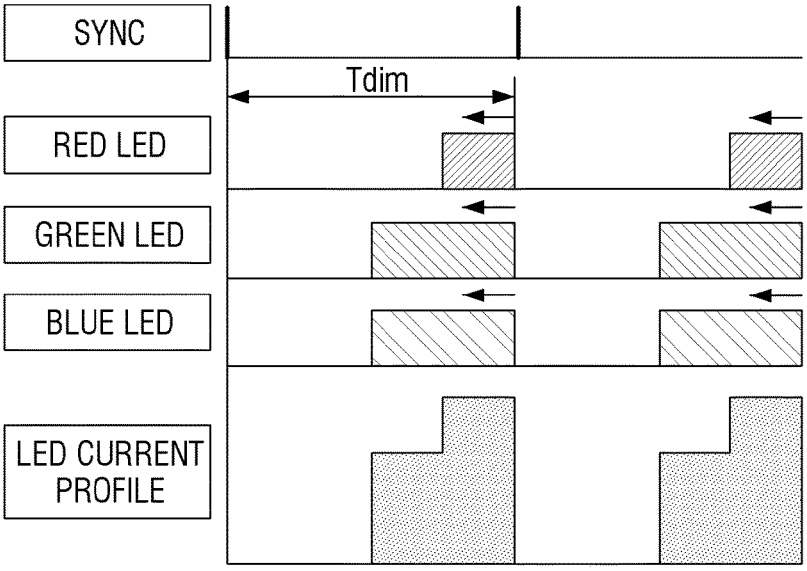

FIGS. 5A, 5B and 5C are diagrams illustrating an example alignment method of LED current. According to an example embodiment, the LED driving apparatus 100 may align each of LED driving sections by three methods.

FIGS. 5A to 5C illustrate a conventional method in which all LEDs corresponding to R, G and B are aligned in the same section. In this case, as illustrated in the LED current profile, peak current may occur. The peak current may lead to heat emission and stress of a power circuit.

A frame unit may be divided with reference to a synchronization signal of an image signal (e.g., a Vsync). Each of the frame units may be maintained during the time of Tdim.

FIG. 5A is a diagram illustrating a head alignment method in which constant current is supplied to an LED at a time of a front end of a frame. The head alignment method is to arrange an LED driving section at the time after the frame start point.

FIG. 5B is a diagram illustrating a center alignment method in which constant current is supplied to an LED in a middle of the frame. The center alignment method is to arrange an LED driving section before and after the middle point of the frame.

FIG. 5C is a diagram illustrating a tail alignment method in which constant current is supplied to an LED at the time of an end of the frame. The tail alignment method is to arrange an LED driving section at the time before the end point of the frame.

Figure 6:
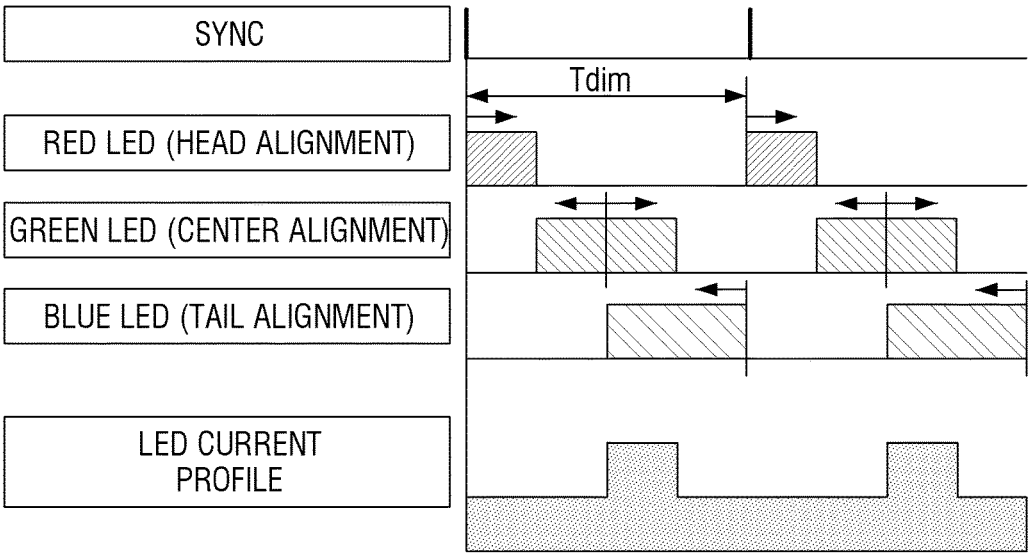
FIG. 6 is a diagram illustrating an example LED driving apparatus which uses a method of dispersion alignment according to an example embodiment.

As illustrated in FIG. 6, the LED driving apparatus 100 according to an example embodiment may disperse the time of a driving section for each of LEDs.

Referring to FIG. 6, the controller 130 may arrange constant current for an LED representing R such that the constant current is supplied at the time corresponding to a front end of a frame. The controller 130 may also arrange constant current for an LED representing G such that the constant current is supplied at the time corresponding to a middle of the frame, and arrange constant current for an LED representing B such that the constant current is supplied at the time corresponding to a rear end of a frame.

The LED driving apparatus 100 may reduce overlapping between constant current applying sections (driving sections) by using a different alignment method for each of LEDs representing a different color, respectively.

For example, if the LED driving apparatus 100 consists of LEDs representing three colors R, G and B, the LED corresponding to R may be aligned by a head alignment, the LED corresponding to G by a center alignment, and the LED corresponding to B by a tail arrangement. In the case of the frame in which each LED represents brightness of 33.3%, there would be no section in which the LEDs are lighted simultaneously. In the case of the frame in which each LED represents brightness between 33.3%~50%, there would be the section in which two LEDs are lighted simultaneously. If each LED represents brightness equal to or more than 50%, there would be the section in which three LEDs are lighted simultaneously. The LED driving apparatus 100 according to an example embodiment may minimize the lighting time in which the three color LEDs are simultaneously lighted by appropriately arranging the lighting times of the LEDs.

In the example of FIG. 6, the driving sections of the LED representing R and the LED representing G do not overlap at all. Only the part of the rear end of the driving section of the LED representing G and the part of the front end of the driving section of the LED representing B overlap as illustrated. Accordingly, the section in which peak current occurs in the LED current profile has been considerably reduced than in the example embodiments of FIGS. 5A to 5C.

In the example of FIG. 6, it is described that each of R, G and B have been aligned by the methods of head alignment, center alignment and tail alignment, respectively. However, the alignment method for a driving section of each LED may be determined otherwise.

The controller 130 may analyze an input image signal, and identify brightness of each R, G and B. The brightness of the input image may correspond to a driving time of each of LEDs representing a different color. For example, in an image frame in which a red color is represented brightly, the LED representing R should be operated for a long time. Thus, the controller 130 may analyze an image and determine a driving time of each of LEDs representing R, G and B.

The controller 130 may arrange the driving sections of two LEDs having a short driving time in the front end or the rear end of the frame, respectively. For example, if the driving times of LEDs corresponding to R and G are shorter than the driving time of an LED corresponding to B among LEDs representing R, G and B, the controller 130 may arrange each of the driving sections of LEDs corresponding to R and G in the front end or the rear end of the frame. Then, the controller 130 may arrange the driving section of LED corresponding to B having the longest driving time in the middle of the frame. That is, the controller 130 may align the driving section of LED having the longest driving time by the center alignment.

Figure 7:
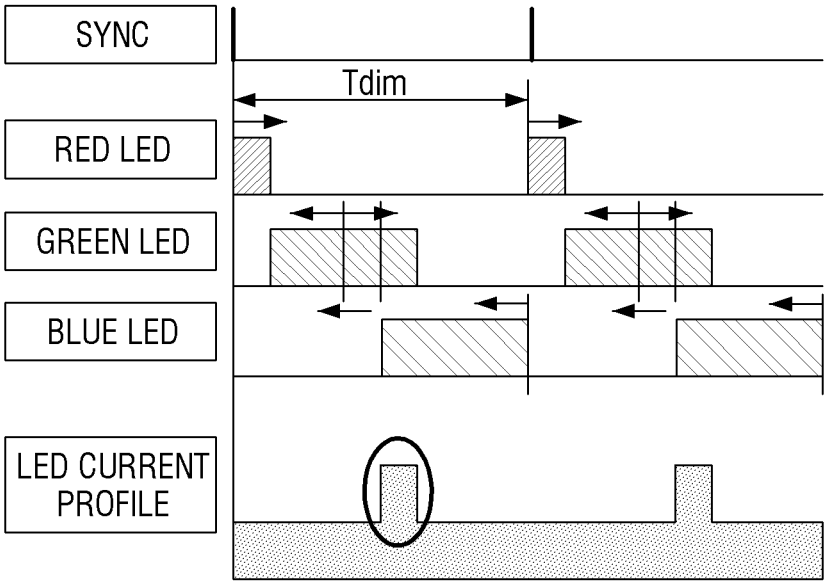
FIG. 7 is a diagram illustrating an example LED driving apparatus which uses a method of dynamic alignment according to an example embodiment.

Referring to FIG. 7, the controller 130 may not align the driving section of LED having the longest driving time by center alignment, but change the arrangement position of the driving section of LED having the longest driving time in order to minimize an overlapping section with reference to the arrangement situation of the driving sections of the remaining LEDs.

In the example of FIG. 7, as a result of analyzing an image by the controller 130, it is assumed that the driving times of LEDs representing R and B are shorter than the driving time of LED representing G.

The controller 130 may firstly align each of the driving sections of the remaining LEDs representing R and B by head alignment and tail alignment, respectively, except for the LED representing G which has the longest driving time among the LEDs representing R, G and B.

Then, the controller 130 may align the driving section of the LED having the longest driving time by center alignment. In the example of FIG. 7, however, as the driving time of the LED corresponding to R is short, the controller 130 may arrange the driving section of the LED corresponding to G after moving the driving section, from the center, to the part where the driving section of LED corresponding to R is arranged. As in FIG. 7, by changing the alignment section dynamically, the LED driving apparatus 100 may further reduce an overlapping section than in simply aligning the driving sections of R, G and B LEDs by head alignment, center alignment and tail alignment, respectively.

The controller 130 may minimize and/or reduce occurrence of peak current by differentiating the arrangement of the driving sections of LEDs at every frame unit. The controller 130 may analyze an image signal at every frame, and determine that the driving section of which color of LED among LEDs representing R, G and B is arranged in the middle of the frame. Then, the controller 130 may shift the driving section of the LED arranged in the middle, and control the overlapping section to be minimized.

Figure 8:
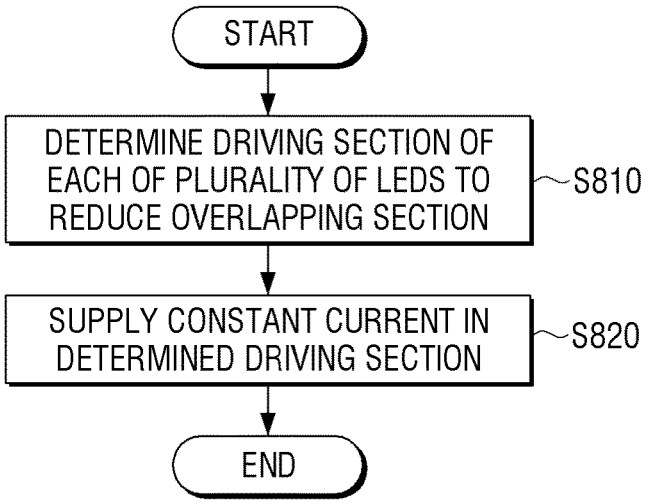
FIGS. 8 and 9 are flowcharts illustrating an example LED driving method according to various example embodiments.
Figure 9:
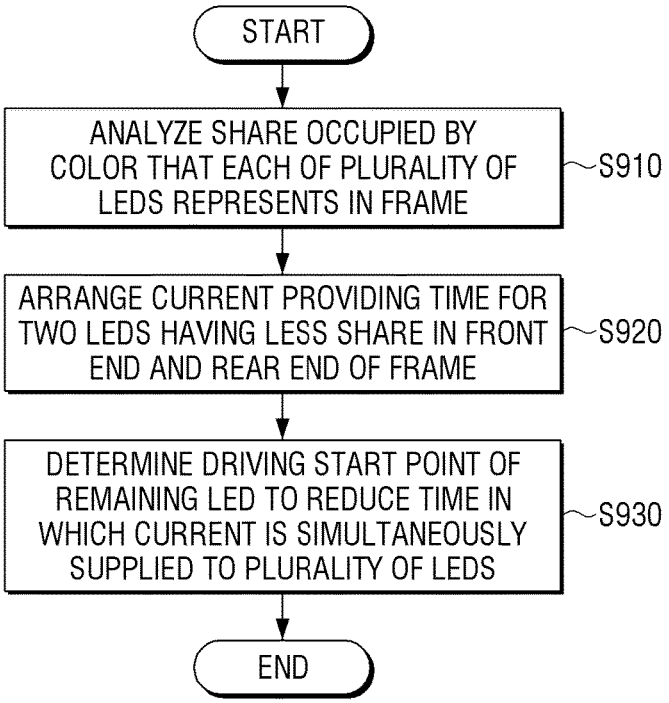

FIGS. 8 and 9 are flowcharts illustrating an LED driving method according to various example embodiments.

Referring to FIG. 8, the LED driving apparatus 100 may determine a driving time of each of the plurality of LEDs to minimize and/or reduce an overlapping section (S810). The LED driving apparatus 100 may include a plurality of LEDs representing a different color, respectively.

Firstly, the LED driving apparatus 100 may determine a driving time of each of LEDs which corresponds to brightness of an input image. If the image is bright, the driving time should be long. The LED driving apparatus 100 may also arrange the remaining LEDs except for the LED having the longest driving time in a front end or a rear end of a frame. By arranging the driving section of the LED having a short driving time at the end, the probability of overlapping between the driving sections of different LEDs may be lowered.

As another example, the LED driving apparatus 100 may arrange the driving section of each R, G and B by methods of head alignment, center alignment and tail alignment.

The LED driving apparatus 100 may apply constant current to each of the plurality of LEDs in a determined driving section (S820).

Referring to FIG. 9, the LED driving apparatus 100 may analyze an image by a frame unit, and calculate (determine) a share occupied by a color that each of the plurality of LEDs represents in the frame (S910). The LED driving apparatus 100 may arrange a current providing time for two LEDs having a less share in the front end and the rear end of the frame (S920).

The LED driving apparatus 100 may also determine a driving start point of the LED having the largest share to minimize and/or reduce the time in which current is simultaneously supplied to the plurality of LEDs (S930). Simply by aligning the driving start point of the LED having the largest share by center alignment, occurrence of peak current may be considerably reduced in comparison to the conventional art. The LED driving apparatus 100, however, may further reduce occurrence of peak current by appropriately changing the driving start point of the LED having the largest share in consideration of the driving times of the remaining LEDs.

According to various example embodiments as described above, the time in which a plurality of LEDs are lighted simultaneously may be minimized and/or reduced. Thus, as peak current can be reduced, heat emission and stress of a power circuit may also be reduced.

The methods described above may be implemented as a form of program command that can be performed through various computer units, and be recorded in a computer readable medium. The computer readable medium may include a program command, a data file, a data structure or the like, alone or a combination thereof. The program commands recorded in the computer-readable medium may be designed for the example embodiments or be known to those skilled in a field of computer software. The examples of a computer readable medium include a hardware device which is specially configured to store and carry out a program command, e.g. a hard disk, a floppy disk, a magnetic media such as a magnetic tape, an optical media such as a CD-ROM and DVD, a magneto-optical media such as a floptical disk, a ROM, a RAM, a flash memory and the like. The examples of program commands not only include machine codes which are made by a compiler, but also high-level language code which can be executed via computer by using interpreter. The hardware device may be configured to operate as one or more software modules. Conversely, software modules may be configured to operate as a hardware device.

The foregoing various example embodiments are merely examples and are not to be construed as limiting the present disclosure. The example embodiments can be readily applied to other types of apparatuses. Also, the description of the example embodiments is intended to be illustrative, and not to limit the scope of the claims, and many alternatives, modifications, and variations will be apparent to those skilled in the art.

What is claimed is:

1. An LED driving apparatus comprising:

a plurality of LEDs configured to represent a different color, respectively, wherein the each of the plurality of LEDs comprises respective LEDs representing red (R), green (G) and blue (B) color;

a current supply configured to supply constant current to each of the plurality of LEDs;

a controller configured to control the current supply to apply constant current to each of the plurality of LEDs at different points in time, and wherein the controller is further configured to determine a driving time of each of the plurality of LEDs representing R, G and B, and to control the current supply to supply constant current for an LED having a longest driving time at a middle of a frame and to supply constant current for remaining LEDs of the plurality of LEDs at a front end or a rear end of the frame.

2. The LED driving apparatus of claim 1, wherein the controller is configured to determine a driving section of each of the plurality of LEDs to reduce an overlapping driving time of each of the plurality of LEDs, and to control the current supply to supply constant current in the determined driving section.

3. The LED driving apparatus of claim 2, wherein the controller is configured to determine a driving time of each of the plurality of LEDs corresponding to brightness of an input image.

4. The LED driving apparatus of claim 1, wherein the controller is configured to change a driving start point of an LED in which constant current is supplied to a middle to reduce an overlapping section between a driving time of an LED in which the constant current is supplied in the middle and a driving time of remaining LEDs.

5. The LED apparatus of claim 1, wherein the controller determines a driving section arrangement for each LED representing R, G and B at every frame unit.

6. A display apparatus comprising:

an LED panel configured to receive an image signal, and to receive a plurality of driving powers for each of a plurality of LEDs representing different colors and to display an image, wherein the each of the plurality of LEDs comprises respective LEDs representing red (R), green (G) and blue (B) color;

an image signal providing unit comprising image signal providing circuitry configured to provide an image signal to the LED panel; and an LED driver configured to apply constant current to each of the plurality of LEDs at different points in time, wherein the LED driver is further configured to determine a driving time of each of the plurality of LEDs representing R, G and B, and to supply constant current for an LED having a longest driving time at a middle of a frame and to supply constant current for remaining LEDs to a front end or a rear end of the frame.

7. The display apparatus of claim 6, wherein the LED driver is configured to determine a driving section of each of the plurality of LEDs to reduce an overlapping section of a driving time of each of the plurality of LEDs, and to supply constant current in the determined driving section.

8. The display apparatus of claim 6, wherein the LED driver is configured to change a driving start point of an LED in which constant current is supplied to a middle to reduce an overlapping section between a driving time of an LED in which the constant current is supplied in the middle and a driving time of remaining LEDs.

9. A method of driving a plurality of LEDs configured to represent a different color, respectively, the method comprising:

determining a driving section of each of the plurality of LEDs to reduce an overlapping section of a driving time of each of the plurality of LEDs; and applying constant current to each of the plurality of LEDs in the determined driving section, wherein the determining comprises determining a driving section, supplying constant current for an LED having a longest driving time at a middle of a frame and supplying constant current for remaining LEDs at a front end and/or a rear end of the frame.

10. The method of claim 9 further comprising:

determining a driving time of each of the plurality of LEDs corresponding to brightness of an input image.

* * * * *